US006062517A

United States Patent [19]

Torres et al.

[11] Patent Number: 6,062,517

[45] Date of Patent: May 16, 2000

[54] CARPET SHIM

[76] Inventors: Joseph A. Torres, 58219 Kimber, Washington, Mich. 48094; Robert T. Elgin, 555 Carleton-Rockwood Rd., Carleton, Mich. 48117

[21] Appl. No.: 09/073,183

[22] Filed: May 5, 1998

[51] Int. Cl.[7] ..... F16M 11/24

[52] U.S. Cl. ..... 248/188.2; 16/4; 16/16

[58] Field of Search ..... 248/346.01, 346.05, 248/346.11, 345.1, 615, 633; 428/131, 192; 16/10, 16, 4, 90, 17.1; 52/717.03, 717.05

[56] References Cited

U.S. PATENT DOCUMENTS

| | | | |
|---|---|---|---|
| 1,430,981 | 10/1922 | Goldthwaite | 16/17.1 |
| 1,598,127 | 8/1926 | Fleming | 16/17.1 |
| 1,722,600 | 7/1929 | Connelly . | |
| 2,449,904 | 9/1948 | Lorraine | 16/7 |
| 2,926,378 | 3/1960 | Eichhorn et al. | 16/4 |
| 2,994,905 | 8/1961 | Franker, Jr. | 16/7 |
| 2,996,751 | 8/1961 | Roby et al. | 16/7 |
| 3,003,185 | 10/1961 | Grunwald | 16/16 |
| 3,010,141 | 11/1961 | Grunwald | 16/16 |
| 3,208,096 | 9/1965 | Linsky | 16/16 |
| 4,187,656 | 2/1980 | Lutz | 52/273 |
| 4,759,096 | 7/1988 | Dorris | 16/4 |
| 5,756,176 | 5/1998 | Feld | 428/48 |
| 5,766,726 | 6/1998 | Bannister | 428/119 |

*Primary Examiner*—Leslie A. Braun
*Assistant Examiner*—Gwendolyn Baxter
*Attorney, Agent, or Firm*—Young & Basile, P.C.

[57] ABSTRACT

A shim for providing a gradual ramp between adjacent flooring materials includes a right angled triangular strip having grooved lines across its width for easy scoring with a knife for height adjustment. Fan-shaped end caps provided for abutment to the triangular strip and having corresponding grooved lines for height adjustment to provide a ramp across a 180° radius.

13 Claims, 3 Drawing Sheets

CARPET SHIM

FIELD OF THE INVENTION

The invention relates to a carpet shim for gradually elevating one floor surface area to the level of an adjacent floor surface area.

BACKGROUND OF THE INVENTION

It is common in people's homes to implement different floor surface materials for different rooms. For example, in a room such as a kitchen, tile, ¾" wood, or vinyl sheeting is commonly used. Alternatively, in a room such as a living room or bedroom, carpeting is the preferred floor covering. When such rooms having different flooring material are adjacent to each other, it is necessary to install an angular set-in to gradually flow from one height to the other height of the flooring material. In the past, the angular set-in has included a marble strip set adjacent carpeting and adjoining tile. The angular set-in has also included a metallic strip placed over carpeting and adjoining vinyl flooring. Both of these techniques can be unsightly and as well as costly.

It is desirable to provide a carpet shim that eliminates height problems during carpet installation, is unseen by the consumer, is versatile and temperature independent and which can be penetrated by nails and easily scored with a knife.

SUMMARY OF THE INVENTION

The present invention addresses the aforementioned concerns. The invention provides a carpet shim that may be used for either residential, industrial, or commercial buildings to gradually level the carpet in one room to any adjacent floor.

The shim is essentially a narrow right angled triangular piece of material having a number of scoring lines for easy breakoff at various heights of the triangular shim. Fan shaped end caps are also provided having the same scoring lines to abut against the triangular shaped shim. The end caps prevent a ramping effect with drop off sides in a doorway. End caps may also be formed from portions of the triangular shim.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 2:
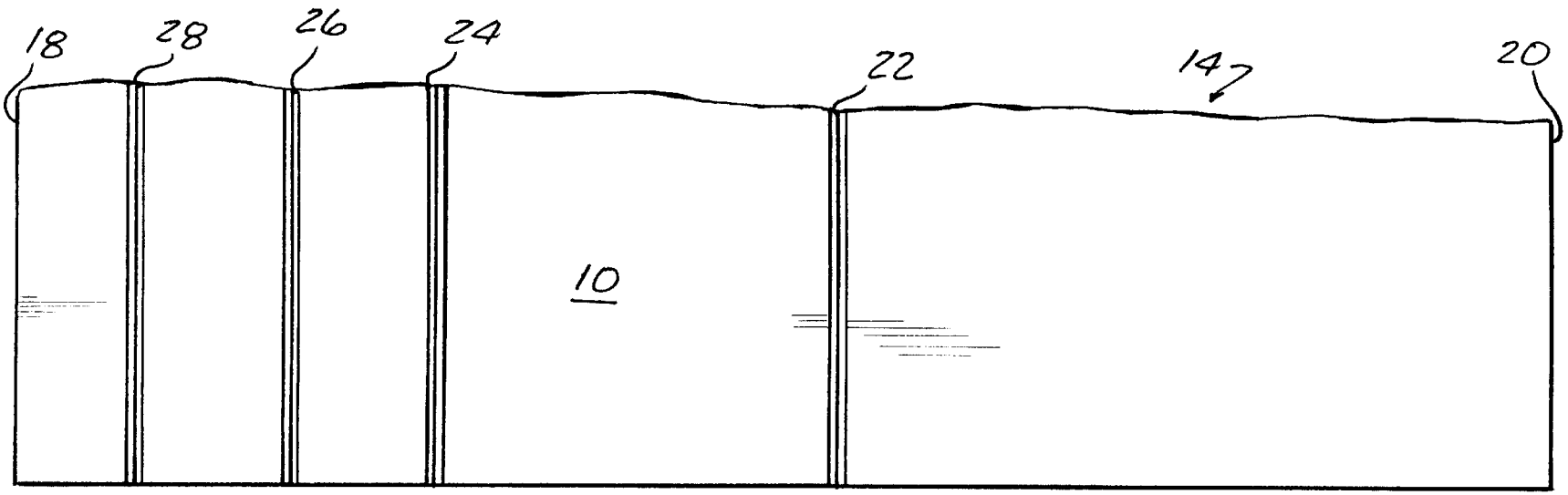
FIG. 2 is a partial plan view of the carpet shim of FIG. 1 taken along lines 2—2.
Figure 1:
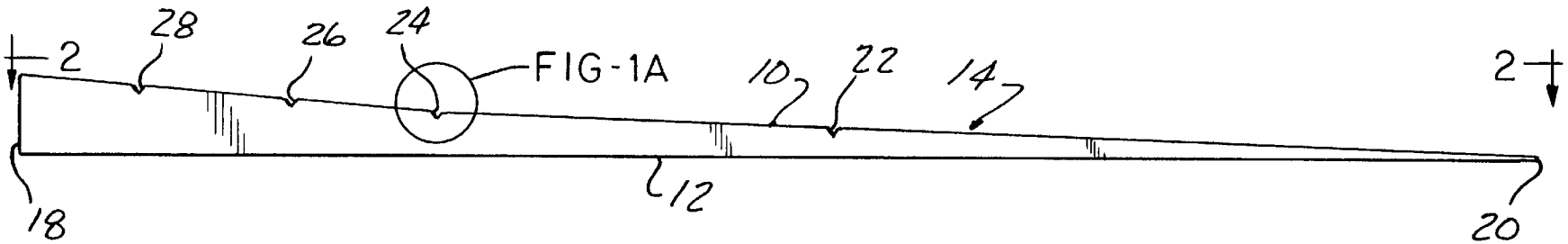
FIG. 1 a side view of the carpet shim according to the present invention.

The carpet shim shown in FIGS. 1 and 2 has a shallow ramp 10 on a planar base 12 to form a triangular structure 14 (also referred to as the carpet shim). The planar base 12 preferably has a length of 16" which can be shortened as required. The maximum height at one end 18 of ramp 10 is preferably ¾", and the lowest height at the other end 20 is less than or equal to 1/16". Although the linear length 12 has a preferred maximum length of approximately 16", the width may vary greatly to accommodate various entry way widths. Typically, the width of the carpet shim 14 will range from three to six feet.

The ramped surface 10 is configured to include two separate angles of inclination or pitch. The first angle of inclination extends from the narrow end 20 of the carpet shim to a point where the carpet shim is at a height of ⅜". This point is designated as 24. A groove 24 traverses the width of the ramp at the ⅜" designation point for identification purposes and for reasons explained further. From the ⅜" groove 24 to the high end 18 of the carpet shim 14, where the carpet shim height is ¾", the angle of inclination or pitch is slightly steeper than the previous pitch from the narrow end 20 to the ⅜" groove 24. In other words, it takes approximately ¾ of the linear length of the carpet shim 14 to increase the height by approximately ⅜". It takes the remainder of the linear length of the carpet shim (one quarter of the linear length) to increase the height another ⅜". In the preferred embodiment, the linear length from the shallow end 20 of the carpet shim 14 to the ⅜" groove 24 is 11⅜". It is another 4⅝" from the ⅜" groove to the end 18. The purpose for the change in pitch along the ramp 10 is to provide for adequate ramp length and a gradual incline from the narrow end 20 to a groove identifying the ¼" height 22, as well as to the groove indicating the ⅜" height point 24.

Figure 1A:
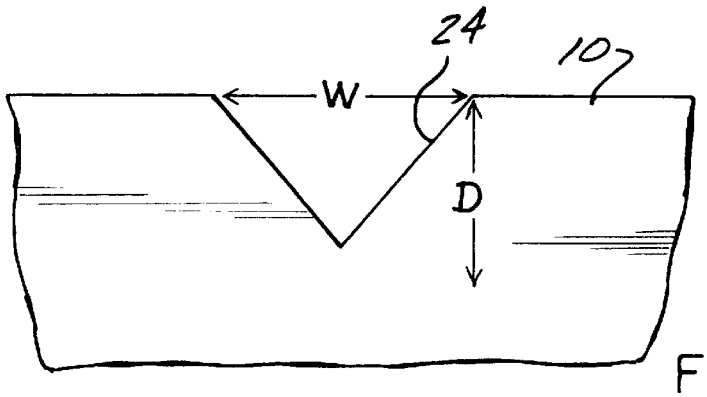
FIG. 1*a* is an enlarged view of the circled area in FIG. 1.

As previously indicated, at designated heights of the carpet shim along the ramp surface 10 there are grooves that traverse the ramp surface 10 as shown in FIG. 2. The grooves or score lines are located at the ¼" height point 22, ⅜" height point 24, ½" height point 26 and ⅝" height point 28. It is understood that the height locations of the score lines can be changed to accommodate requirements of the flooring industry. The score lines are essentially V-shaped and are better shown in FIG. 1*a*. The preferred width (W) and depth (D) of each score line is 3/32". The score lines provide a measurement guide for the height of the ramp 10 at a particular point, as well as a cutting guide. The score lines are preferably V-shaped for easy containment of a cutting tool.

Figure 6:
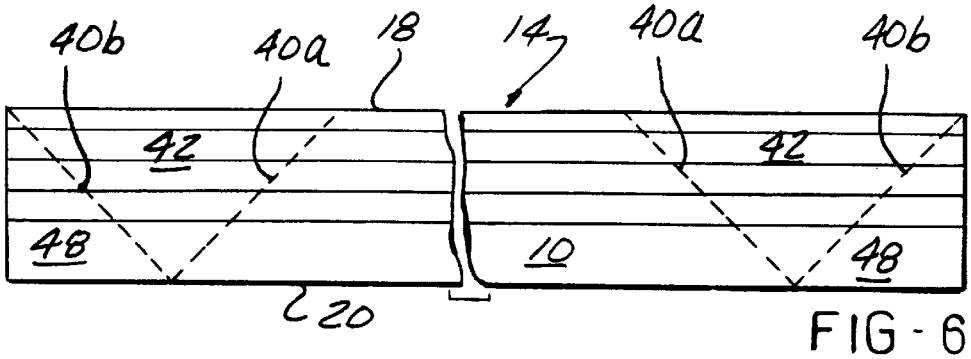
FIG. 6 is a plan view of a portion of the triangular carpet shim showing mitered cut lines.

Looking at FIG. 2, the perpendicular lines correspond with the scored grooves of FIG. 1. In addition to the straight line grooves, there may also be angled 45° lines 40*a*, 40*b* stamped or drawn onto the incline surface 10 of the carpet shim, as shown in FIG. 6. These stamped 45° angled lines 40*a*, 40*b* are provided for convenience as a cutting and mitering guide. The purpose of the stamped lines will be discussed further.

Figure 5:
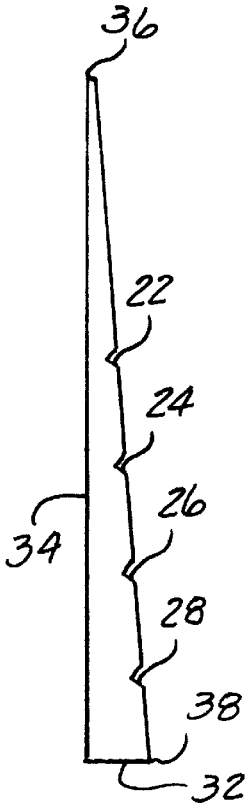
FIG. 5 is an end view of the end cap of FIG. 3 taken along lines 5—5.
Figure 3:
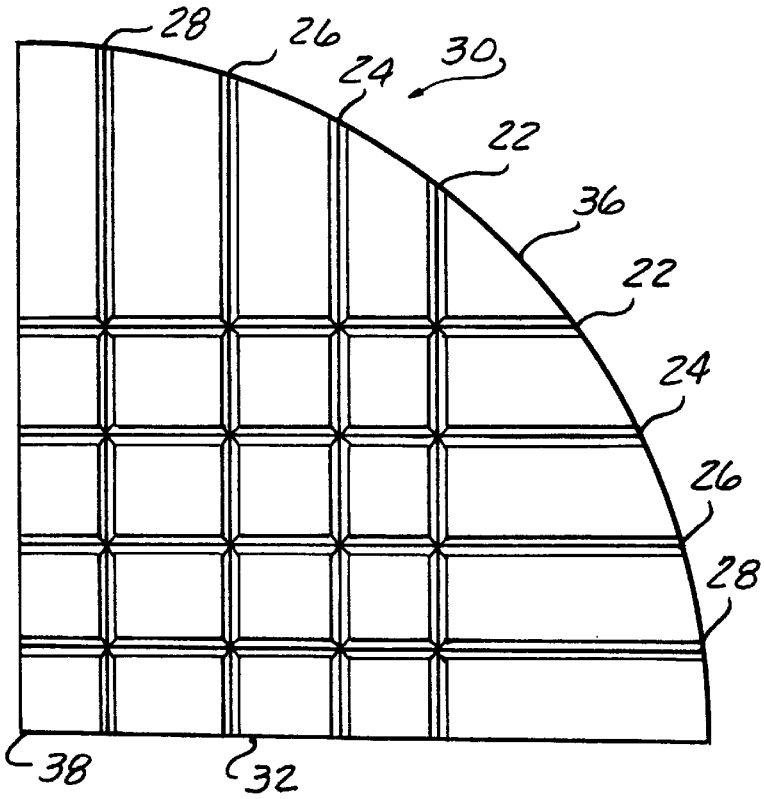
FIG. 3 is a plan view of an end cap for the carpet shim according to the present invention.
Figure 4:
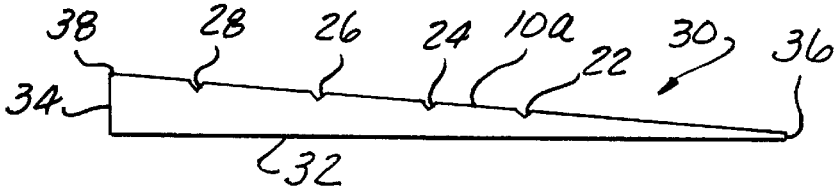
FIG. 4 is a side view of the end cap taken along line 4—4 of FIG. 3.
Figure 7A:
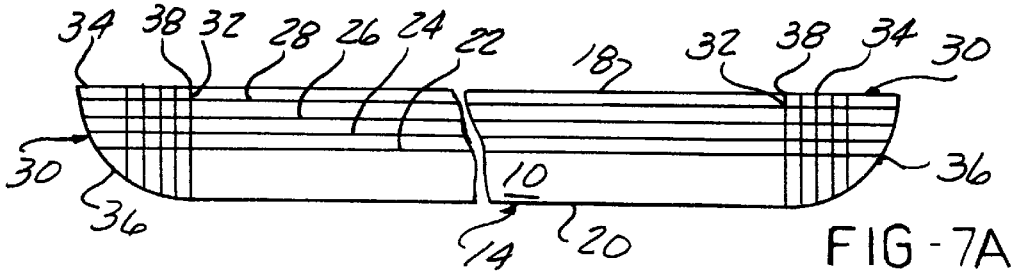
FIG. 7*a* is a plan view of the end caps adjacent to the triangular carpet shim.
Figure 7B:
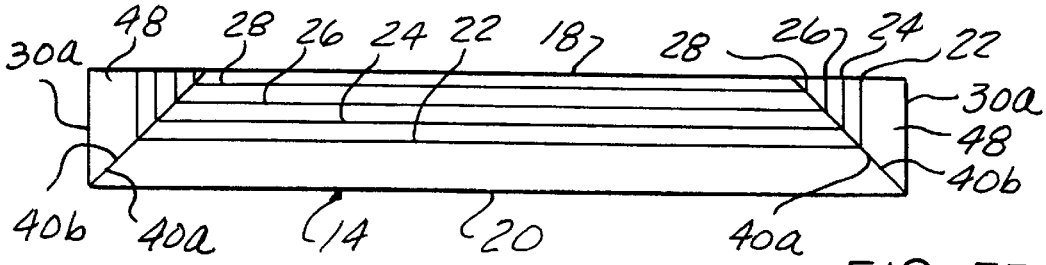
FIG. 7*b* is a plan view of mitered end caps adjacent to the triangular carpet shim.

End caps 30 are provided to be placed adjacent and abutting to each side of the triangular carpet shim 14 to gradually change the floor height from one room to another over a 180° range. Two types of end caps are shown in FIGS. 7*a* and 7*b*. In one embodiment, an end cap 30 having a fan-shaped configuration is placed on either side of the triangular structure 14. FIGS. 3–5 show various views of the end cap 30 of the present invention having the general fan-shaped configuration. FIGS. 4 and 5 show respective side views of the end cap 30 with the V-shaped scoring lines at the designated height levels that correspond to the scored lines of the triangular structure 14. The fan-shaped end cap 30 has an inclined surface 10*a* that corresponds to the inclined surface 10 of the triangular carpet shim 14. Therefore, the inclined surface 10*a* of end cap 30 also has two angles of inclination. The linear edges 32 and 34 of the end cap 30 have the same dimension as the linear length 12 of the triangular structure 14, that is 16" in the preferred embodiment. The end cap 30 also has an arcuate narrow edge 36 which corresponds to the end 20 of the triangular carpet shim. The 90° lines on the plan view in FIG. 3 of the end cap 30 also correspond with the grooves shown in FIGS. 4 and 5. FIG. 7*a* shows the alignment of the end caps 30 to the triangular carpet shim 14. As can be seen, the highest point of the end cap 30 is at the 90° corner 38.

An alternate means of tapering the lateral edges of the triangular structure 14 for gradually adjustment of the height of the carpet to another surface area is shown in FIG. 7*b*. The alternate means uses the triangular carpet shim 14 and the stamped lines 40*a*, 40*b* thereon to form end caps 30*a*. Looking at FIG. 6, the ramp surface 10 includes mitered lines 40*a* and 40*b* forming a center triangular portion 42 printed on the surface as guides to cut 45° angles relative to the grooves from the triangular structure 14. The triangular portion 42 bordered by mitered lines 40*a* and 40*b* is discarded. The end right angle triangles 48 remain and define the end caps 30*a*. The right angle triangles 48 are rotated so that the diagonal edge formed by mitered line 40*b* is placed against the edge on the triangular structure 14 formed by mitered line 40*a*, as shown in FIG. 7*b*. As a result, a 180° gradual ramping is provided from a door or entry way having a material flooring with a higher elevation than the adjacent flooring material.

Figure 8:
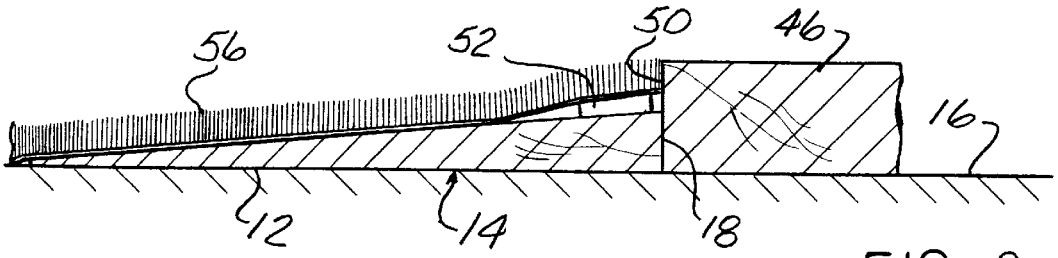
FIG. 8 is a side sectional view showing the carpet shim applied between different types of floor covering.

FIG. 8 shows the current invention in use, wherein the carpet shim 14 gradually levels the exposed surface between two different flooring material. A portion of the subfloor 16 is shown. On top of the subfloor 16 at one end is an example of a flooring material 46 such as tile, marble, wood having a height higher than an adjacent carpeted area. The procedure to gradually ramp the carpet 56 to the height of the tile 46 is to lay the triangular structure 14 of the carpet shim against the subfloor 16 with the vertical end 18 abutting against the exposed material edge 50 of the tile, marble or oak 46. A carpet tack strip 52 is then laid on top of the carpet shim 14 adjacent the peripheral edge of the carpet 56. The carpet 56 is then placed over the carpet shim 14 and tack strips 52. The example shown in FIG. 8 and disclosed herein refers to carpet adjacent a higher flooring material. It is understood that the invention may be used with any flooring material that needs to be gradually raised to a level of an adjacent flooring material.

Figure 9:
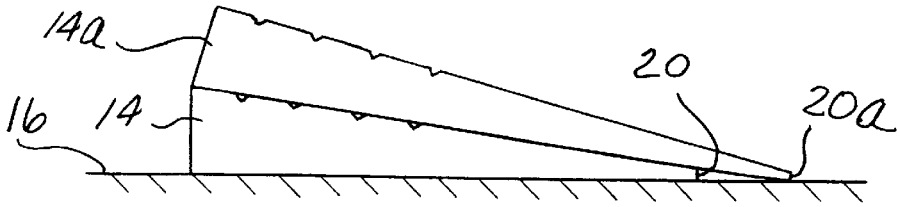
FIG. 9 is a side view indicating the proper layering of the carpet shims to increase the height at one end.

If the height of the adjacent floor material 46 does not require the full ¾" height of the carpet shim 14, the carpet shim 14 can be scored with a razor blade or knife along the appropriate groove line 22, 24, 26, or 28 to provide a rise of ¼", ⅜", ½", or ⅝" respectively. The adjacent piece from the scored groove line to end 18 can be easily snapped off and discarded forming a new vertical end. The new vertical end of the carpet shim 14 is placed adjacent to the higher flooring material 46. If the height of the adjacent floor material requires a height greater than the ¾" height provided by the present invention, then the installer can lay a second carpet shim 14*a* over the first carpet shim 14 such that the narrow end 20*a* of the second carpet shim 14*a* extends beyond the narrow end 20 of the first carpet shim. Offsetting the second carpet shim 14*a* prevents a rib from forming when the carpet 56 overlays the narrow end of the carpet shim 14 when doubling the height. The correct and preferred method for overlaying carpet shims is illustrated in FIG. 9. An alternate method of overlaying the carpet shims is for carpet shim 14*a* to be placed over carpet shim 14 such that narrow end 20 extends beyond narrow end 20*a*.

Although the carpet shim 14 can be manufactured from a various number of materials, a versatile material is preferred. It is preferred that the material can easily be penetrated by nails and knives and easily and cleanly snapped at the scored lines. It is also preferred that the material is resistant to temperature extremes, such as freezing or melting, experienced in industrial and commercial buildings. For these reasons, rubber or plastic material is preferred.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A carpet shim for providing a gradual ramp between adjacent flooring materials comprising a right angled triangular strip having an inclined surface, said inclined surface having at least one notch traversing the inclined surface for defining a scoring line, wherein said inclined surface includes miter lines drawn at 45° angles from the scoring line.

2. The carpet shim of claim 1, wherein the inclined surface includes more than one angle of inclination.

3. The carpet shim of claim 1, wherein the triangular strip is made of a material penetrable by nails and resistant to freezing and melting.

4. The carpet shim of claim 1, wherein the triangular strip is made of one of rubber and plastic.

5. A carpet shim for providing a ramp between adjacent flooring materials comprising a right angled fan-shaped strip having an inclined surface wherein said strip has two linear peripheral edges intersecting to form a right angle and an arcuate edge intersecting the linear peripheral edge having a higher end at a corner formed by the right angle and a lower portion at the end arcuate edge of the fan-shaped strip; and a narrow right angle triangular strip having an inclined surface and two opposing ramped peripheral edges, wherein at least one peripheral edge of the fan-shaped strip abuts to one of the ramped peripheral edges of the narrow right angle triangular strip.

6. The carpet shim of claim 5 further comprising at least one scoring line parallel to one of the linear peripheral edges.

7. The carpet shim of claim 5, wherein the inclined surface of the triangular strip has more than one angle of inclination.

8. The carpet shim of claim 7, wherein the inclined surface of the fan-shaped strip corresponds to the inclined surface of the triangular strip.

9. A unitary carpet shim for providing a gradual ramp between adjacent flooring materials for installing on a subfloor, the flooring materials including a first flooring material having a higher vertical edge than a vertical edge of the second or adjacent flooring material, said shim comprising: a solid right angled triangular strip having a flat base for positioning on the subfloor and an inclined surface for positioning entirely under the second flooring material, said inclined surface having at least one notch traversing the inclined surface for defining a scoring line wherein the inclined surface has more than one angle of inclination.

10. The carpet shim of claim 9 further comprising a third side for abutting against the vertical edge of the first flooring material.

11. The carpet shim of claim 9 wherein the triangular strip is made of material penetratable by nails and resistant to freezing and melting.

12. The carpet shim of claim 9, wherein the triangular strip is made of one of rubber and plastic.

13. The carpet shim of claim 9, wherein said inclined surface includes at least one meter line drawn at a 45° angle from the scoring line.

* * * * *